United States Patent [19]

Valot

[11] Patent Number: 4,688,751

[45] Date of Patent: Aug. 25, 1987

[54] SOAP-CAKES WITH MOUNTING AND LOCKING MEANS ON SUPPORT-ARMS THEREOF

[76] Inventor: Eduardo A. Valot, Rivadavia 1170, Buenos Aires, Argentina

[21] Appl. No.: 620,189

[22] Filed: Jun. 13, 1984

[51] Int. Cl.[4] ..... A45D 40/00

[52] U.S. Cl. ..... 248/359 D; 248/309.1

[58] Field of Search ..... 248/542, 359 D, 359 C, 248/359 G, 359 J, 309.1, 340, 341, 314

[56] References Cited

U.S. PATENT DOCUMENTS

| | | | |
|---|---|---|---|
| 639,199 | 12/1899 | McKim | 248/359 D |
| 757,638 | 4/1904 | Roake | 248/359 D |
| 2,285,883 | 6/1942 | Anderson | 248/341 |
| 4,309,014 | 1/1982 | Blaszkowski | 248/359 D |

FOREIGN PATENT DOCUMENTS

| | | | |
|---|---|---|---|
| 288121 | 5/1953 | Switzerland | 248/359 J |

*Primary Examiner*—Reinaldo P. Machado
*Assistant Examiner*—Alvin Chin-Shue
*Attorney, Agent, or Firm*—Scully, Scott, Murphy & Presser

[57] ABSTRACT

A combination soap cake and holder for connecting the soap to a support structure. The holder includes a rigid support arm including a forward portion having an annular groove. The soap cake includes an elongated socket, and a tubular conduit is embedded in this socket. The conduit includes a sidewall forming a passageway to pass the forward portion of the support arm into the cake of soap, and a resilient clip, flange, tab or similar device extends into the annular groove on the support arm and permanently locks the cake of soap thereto. A cover, releasably connected to the conduit sidewall, extends around the annular groove and the locking clip, flange or tab to keep the soap away from the locking device and the annular groove.

5 Claims, 22 Drawing Figures

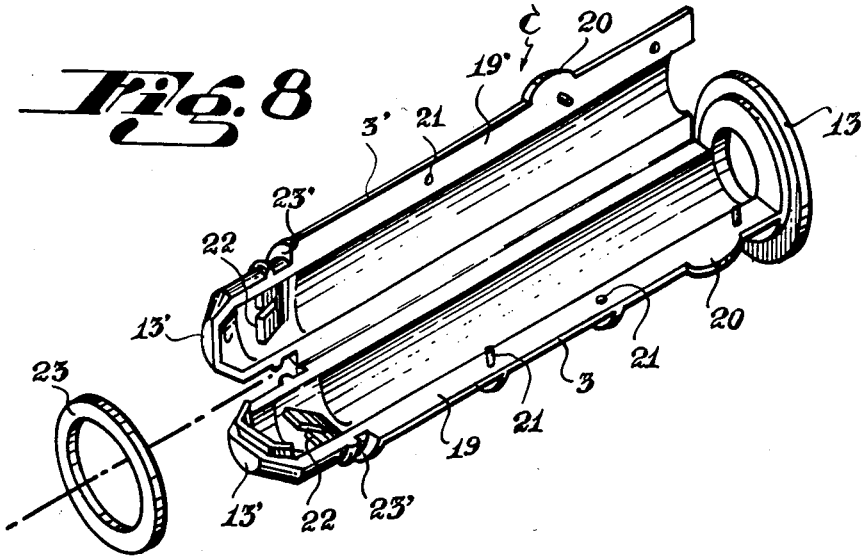
Fig. 8
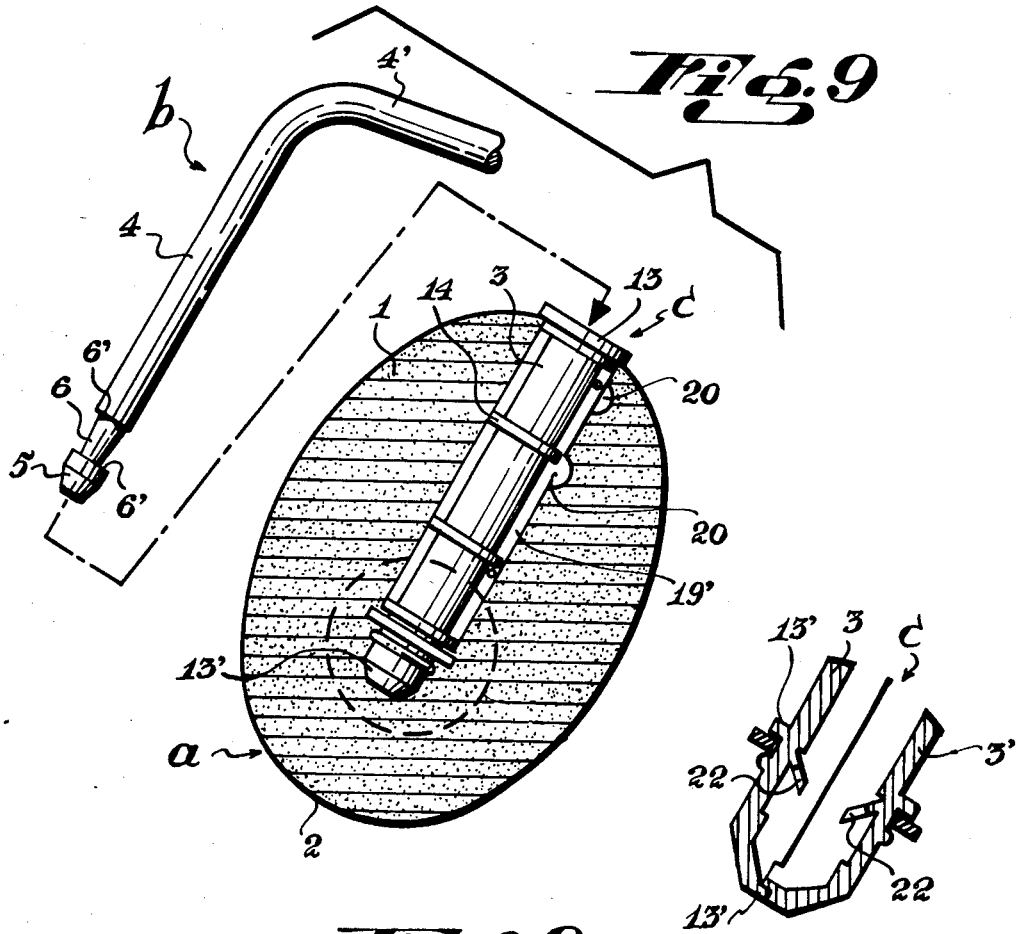
Fig. 9
Fig. 9a

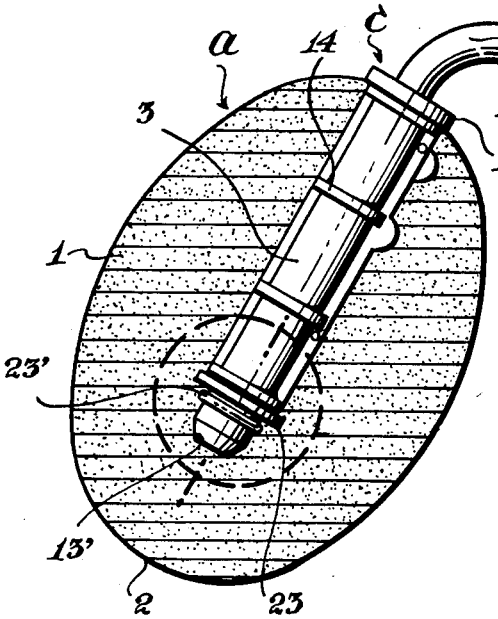
Fig. 10
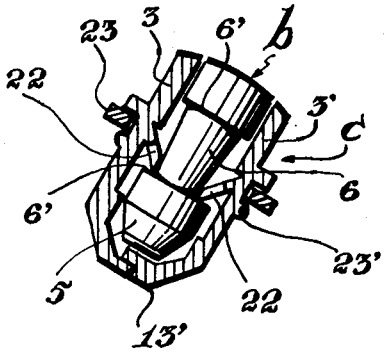
Fig. 10a
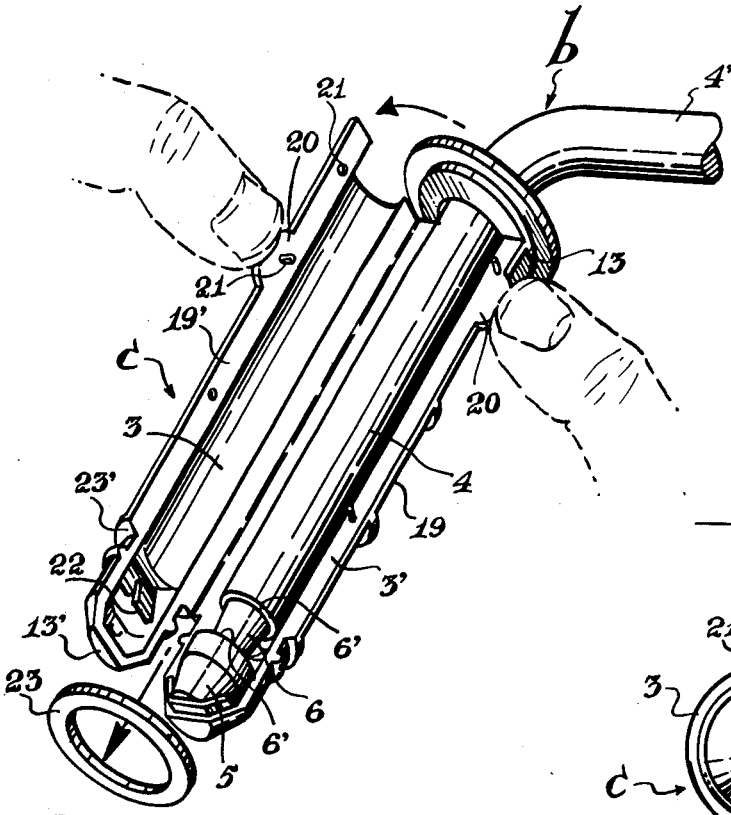
Fig. 11
Fig. 12
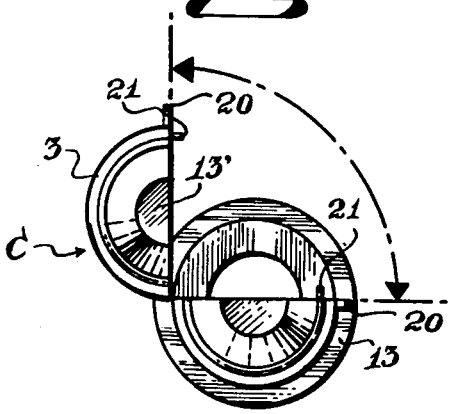

Fig. 13
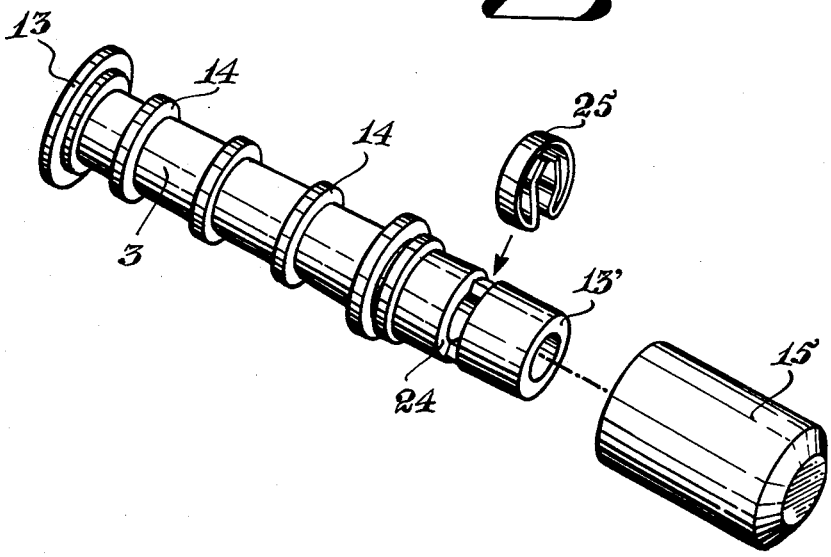
Fig. 14
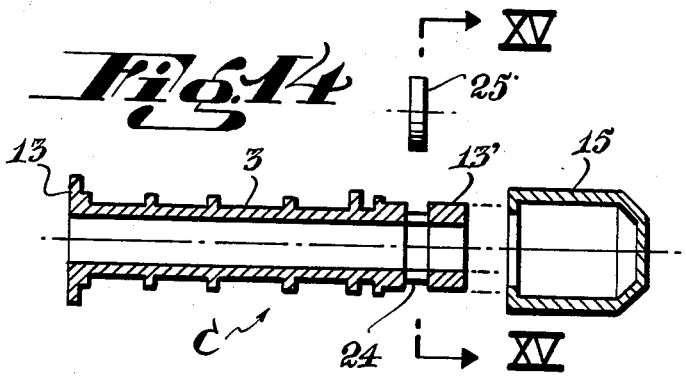
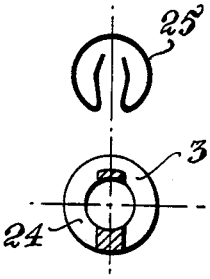
Fig. 15
Fig. 16
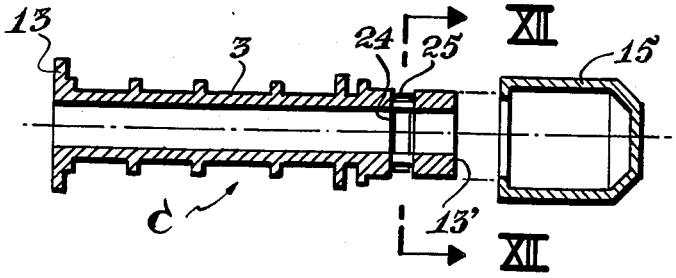
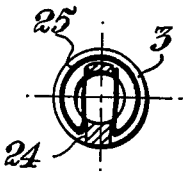
Fig. 17

Fig. 18
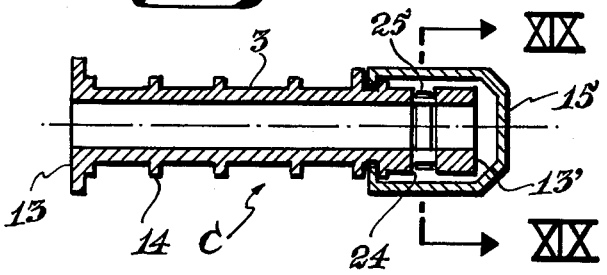
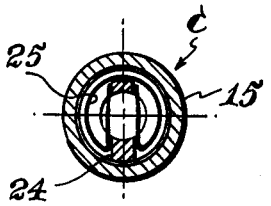
Fig. 19
Fig. 20
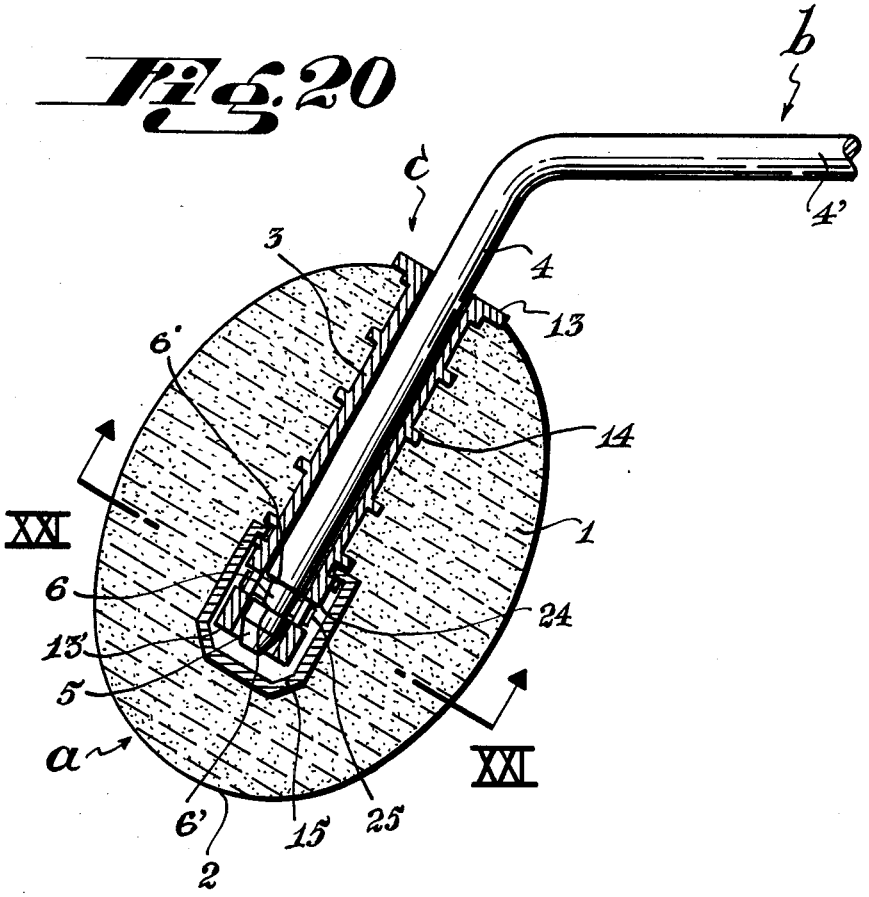

SOAP-CAKES WITH MOUNTING AND LOCKING MEANS ON SUPPORT-ARMS THEREOF

DESCRIPTION

The present invention refers to general hygiene elements, and more particularly to improvements in soap cakes, with mounting and locking means for support arms; specially intended to be employed in public use bath rooms and washbasins. Its object is to provide a structure that notwithstanding its constitutional simplicity, is very effective in locking the soap cake to its holder so as to hinder its removal therefrom; moreover, it is characterized by providing a simplified means for the removal of the used tube once the soap cake around it has been used up.

It must be noted that the inventor through the years has specialized in the study, creation, development, production and marketing of elements intended for the general hygiene, particularly employed in public use bathrooms and washbasins; this study being done with the purpose to allow the user of said rooms to have at hand those elements intended for the hygiene.

In order to better explain the novelty of the invention and the state of the art, it must be said that since far it is known the use of soaps supported by cords, chains and even arms, the latter finished in a threaded portion to be engaged by a nut making easier the mounting, the demounting through the same means and the disengaging of the fixing nut.

There is a background patent, corresponding to U.S. Pat. No. 3,094,806, which provided a clever approach by virtue of which the soap cake had therein a tubular body with an internal locking means blinded thereby and with an external outlet traversed by the end of a soap-holder arm projected from an anchor base.

The system was a true novelty since once the arm end was introduced with the annular slot in the sheath, the locking effect was produced automatically within the soap cake through the fixing means which comprised a cooperating tapering of the tubular body with the conicity the arm formed in said area. Thus, the locking means, by being received within the soap cake, was only exposed once the soap cake had been used up, that is when a new cake was required to replace it, removing first the empty sheath or tubular body.

But, as it can be easily seen from U.S. Pat. No. 3,094,806, indeed, the soap-holder arm had, instead of a slot, a flange forming end which functioned as a butt for the cake when it was pulled in the pulling sense with respect to the arm. But the butt comprised a conical portion -to which cooperated the fixing ends of the tubular body- that since always was the fundamental factor making removal easier.

In effect, when the person trying to remove the soap mounted through the system of U.S. Pat. No. 3,094,806, directly pulls in the sense contrary to the arm, the conical fixing blades will hinder the removal of the soap because of their collision against the end portion; but it will suffice that the arm be moved backwards to allow the fixing blades to be immediately opened thanks to the conicity formed by the arm, allowing sufficient time for the ready removal of the soap from its holder before the blades could be shut.

When the inventor herein studied the problem, he determined that it was necessary to form on the arm a bi-directional locking means which would hinder the moving of the soap cake, not only in the sense of removal, but on the opposite one as well; thus making it impossible to remove the soap by any skillful action.

This may be done by designing an annular slot which defines the temporary lodging for the positional locking means and is characterized by having its faces parallel each other and forming an angle of approximately 90° to the bottom of the slot.

This means that once the positional fixing means have been engaged by force, the soap cannot move along the arm in either of the two senses, notwithstanding its rotational movement around its geometrical axis corresponding to the axis of the holder-arm.

With respect to the locking fixing means on the said slot, it must be said that the inventor has studied many effective possibilities, all of them based on the same principle and intended to be used by the arm with the annular slot of lateral inside and parallel faces, which constitutes the essence of the invention, on which many different variants of the locking means described hereinbelow are improved.

Another aspect studied by the inventor which deserves to be emphasized is, although accesorily, to hinder the angular unlimited movement of the soap-holder arm which may be caused by the base articulation corresponding to said arm, due to the fact that an abrupt operation on the soap-holder arm and the soap supported with respect to its articulating bases may cause the immediate movement of the assembly against the wall, thus damaging the coating thereof; and the inventor seeks to provide on the articulating base, means to limit the angle movement of the arm and soap to prevent them from touching the wall, all of which suggest an hygienic advantage.

The invention has many objects pursued through the elements described and the rest of the system components, the main one being the fact of preventing the soap from being displaced coaxially in any sense.

Another object of the invention is to ensure the protection of the locking area by hindering the access therein of the soap mass, either by structuring a special case or by providing a plug or cap in order to avoid difficulties when trying to demount and remove the tubular body once the soap has been used up.

Another object of the invention is to facilitate the washing of hands by means of the rotation of the soap cake around the holder arm but wherein the locking elements together with the soap do not constitute braking means therefor, and hence, said locking area is isolated from the rest of the soap cake and it cannot enter the resultant voids.

Another object of the invention is to ensure that the sheath or tubular body removal be done by means of longitudinal displacement on the arm through the outlet head, that is through the diameter aperture of said tubular body according to an embodiment variant also created by the inventor.

Another advantage is to ensure, as an alternative, the positional retention of the soap with locking means which, once exposed because of the soap cake using up, may be disabled by tearing through an operation done on the transversal weakness area of the tubular body.

Another purpose of the invention is to ensure an easy positional locking and unlocking of the soap cake on the slot, using a simple demountable pin.

There are other objects and advantages of the invention, besides those described, which will become evident after reading the following specification.

Because of what has been said we can imagine that the invention will be well accepted when put into practice, regardless of the category or destination therefor; since, because of its characteristics, it may be applied as a soap system and a soap-holder arm with safety locking means, which may be employed in bathrooms or wash-basins of shops, industrial plants, enterprises and public entities, institutions and in general in every public use environment where the continuous presence of soap is required, avoiding its removal.

For the sake of simplicity and understanding of the invention object, it is illustrated by means of many figures which represent it, in some of its preferred embodying forms, as an illustrative but not limiting example, where:

FIG. 1 is a perspective view of the tubular body with the locking means, according to an embodiment showing the locking means comprised of resilient flaps having internal teeth engagable in the annular slot; within the same perspective it may be seen the cover which also is part of the locking means, shown in partial section to allow representation of the internal fixing tooth.

FIG. 2 shows in detail the end of the soap-holder arm forming the annular slot of parallel opposite faces which constitute the main characteristic of the invention and where the locking flaps teeth according to the embodiment of FIG. 1 have been represented as engaged. The tubular body and its cover or cap have been represented in longitudinal section within the soapcake, to show how the soap may be automatically and relatively fixed to the arm end once it has been introduced.

FIG. 8 is a perspective view of the tubular body in a new embodying form where the body may be opened into two halves or portions, hinged in the longitudinal sense, including a toothed case as the locking means. The shuting position of the tubular body is defined by means of a fastener such as a ring.

FIG. 9 is a view of the end of the soapholder arm, with the annular slot according to the present embodiment, showing a section of the demounted soap-cake with the tubular body according to FIG. 8 wherein the arm end may be introduced as shown by the arrow sense circle surrounds a detail in longitudinal section of the shut tubular body corresponding to the locking area.

FIG. 9A is an enlarged view showing in cross section the portion of FIG. 9 within the broken circle.

FIG. 10 is another longitudinal section of the soap-cake, the tubular body wherein the arm end has been introduced being received in said soap-cake.

FIG. 10A is an enlarged view showing in cross section the portion of FIG. 20 within the broken circle.

FIG. 11 is a perspective view which shows the way in which the tubular body that may be longitudinally opened is unlocked, according to the embodiment of FIGS. 8 to 10.

FIG. 12 is a front view of the tubular body according to the embodiment of FIGS. 8 to 11 showing the way in which it may be opened once the soap has been used up, in order to facilitate its removal from the arm.

FIG. 13 is a perspective view of the tubular body according to a new embodying from by virtue of which the lateral walls thereof have side openings intended to receive a pin as the locking means.

FIG. 14 is a longitudinal section of the tubular body and its demounted cover, according to FIG. 13.

FIG. 15 is a cross-sectional view of the same tubular body, according to a plane XV—XV of FIG. 14, which shows moreover the pin shape.

FIG. 16 is another longitudinal section of the tubular body according to the embodiment of FIGS. 13 to 15, the pin being introduced in the side openings.

FIG. 17 is a cross-sectional view of the tubular body according to the plane XII—XII of FIG. 16 showing the way in which the pin is located in said tubular body, ready to be introduced by force in the arm.

FIG. 18 is another longitudinal section of the tubular body, with the pin and the plug shutting the locking area.

FIG. 19 is a cross-sectional view of the tubular body and the cover, according to plane XIX—XIX of FIG. 18.

FIG. 20 is a cross and longitudinal section of the soap, the tubular body, the pin and the cover, according to the embodiment of FIGS. 13 to 19, once mounted in the end of the soap-holder arm.

In the figures, same reference numbers indicate same or corresponding parts and the letters indicate assemblies of elements.

Figure 1:
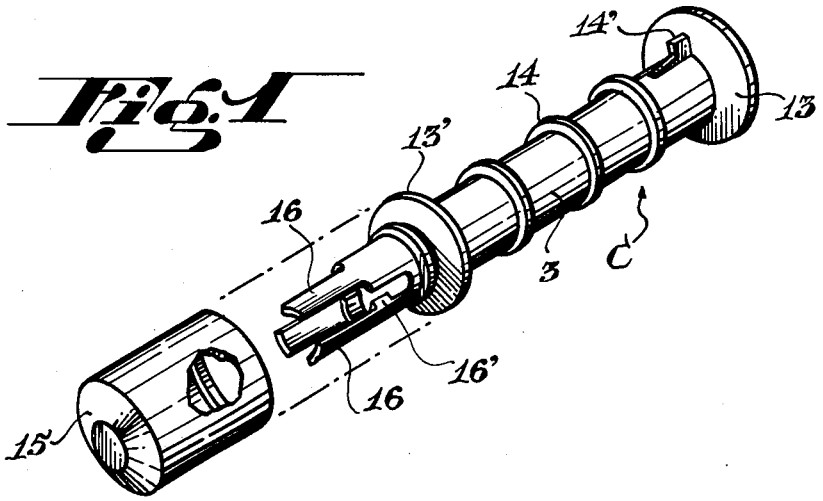

Those references correspond to the following description:

a- soap
b- soap-holder arm
c- tube with antitheft fastener
d- arm b anchor base
1- cake soap
2- blind pole of 1 (opposite the arm inlet)
3- tube body
3'-body, complementary of 3
4- length of arm b end rod
4'-length of intermediate rod of 4
4''-arm b anchor tag
5- pointed end of 4
6- annular slot of 4
6'-slot 6 parallel faces
7- anchor base body 8- articulating flange of 4' in d
9- tag 4'' butt
10- 4'' angular turning-over limiting means
11- anchor means holes
12- anchor base cover
13- 3 end ring forming the inlet
13'-end opposite 13
14- antislipping side annular flanges
14'-antislipping radial flanges
15- c cover
16- resilient flaps
16'-teeth of 16
17- strip which may be teared
17'-bridge of 17 which may be joined to core 18
18- annular core which may be torn
18'-transversal weakness area of 18
19- longitudinal rim of 3
19'-longitudinal rim of 3'
20- holders of 19 and 19'
21- reciprocal embedding means between 19 and 19'
22- fixing engagement internal teeth
23- shuting hoop
23'-engagement slot of 23 in the body 3—3'
24- slot for the pass of c pin
25- pin Generarlly, (a) is the soap-cake comprised of a soap-body (1), for example of oval shape, wherein there is located -in the sense of its longitudinal geometric axle-a tubular body (c) made of plastics or similar proper material, placed completely occluded within said soap-cake (1) except for a flat ring (13) defining the tubular body (c) inlet as a passage duct for the end of the soap-holder arm (b).

More particularly, and as it can be seen from the figures, the soap-holder arm (b) is comprised of a rod, preferably a metal one, formed by an end (4), an intermediate bended length (4') and a tag (4'') which crosses the perforated central body (8) of an anchor base (7) through the holes (11) by means of screws or similar elements and fixes to a wall, a screen, a column, a table or similar member so that the soap-holder arm (b) fixed by means of the anchor system (d) provides soap (a) near the corresponding washbasins.

Figure 3:
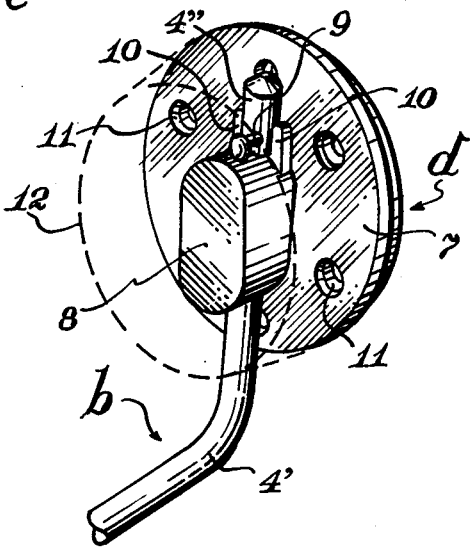
FIG. 3 is an accessory detail of the arm tag showing the way in which the anchor base allows it to be angularly turned over; this turning over being limited so that the soap and its arm do not touch the wall.
Figure 4:
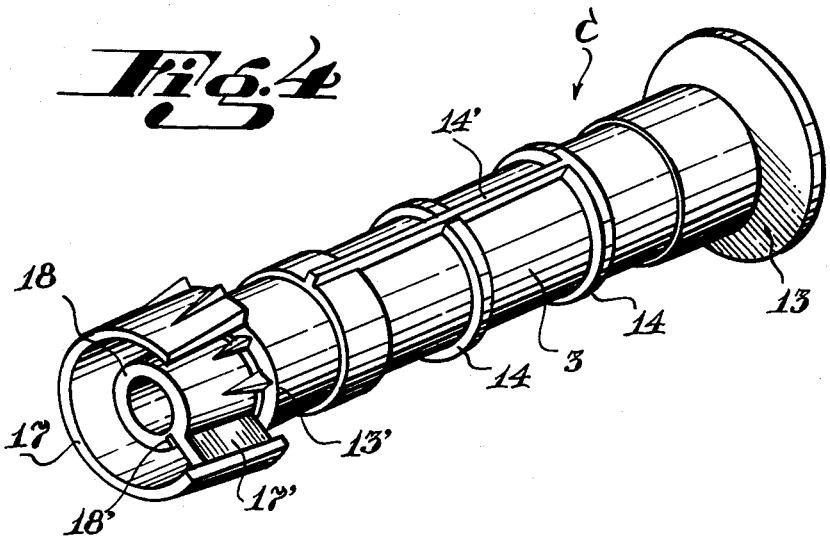
FIG. 4 is a perspective view of the tubular body in one of the embodying forms where the locking means are comprised of a forced pass ring engagable in the annular slot which has a weakness line to provide it a tearing condition.

According to FIG. 3, the arm (b) wherein soap (a) is mounted, has in its tag (4'') a flange (9) which, embedded between other side flanges (10) of the fixing base (7), constitutes a rotation limiting means for the arm (b), so that said arm (b) and its soap (a) do not touch the wall wherein base (7) is fixed. Anchor base (b) is completed by a cover (12) (shown in dot-line) intended to hinder the unthreading of screws introduced in holes (11) by third persons.

Now them, one of the invention essential characteristics is the fact that the end (4) of the soap-holder arm (b), which finishes in a pointed end or conical body (5) in order to facilitate its insertion, has near it an annular side slot (6), the bottom of which may be cylindrical or conical, the slot being limited by two internal, opposite, flat and parallel faces which -by the fact of forming an angle of approximately 90° to the longitudinal geometric axis of end (4)-, constitute both butts in the bidirectional sense defined by the position of the locking means provided by the tubular body (c), regardless their embodiments and according to the following description (FIGS. 2, 5, 9, 10, 11, 20, 21 and 22).

Generally, tubular body (c) is comprised of a tube of walls (3), originating in a flat ring (13) on one end, and terminating with the locking means on the other; the external faces of the walls (3) having flanges or rings (14) that together with other radial flanges (14') are intended to ensure that after molding, the soap cake (1) adheres adequately to tubular body (c) (FIGS. 2, 5, 9, 10 and 20).

Figure 2:
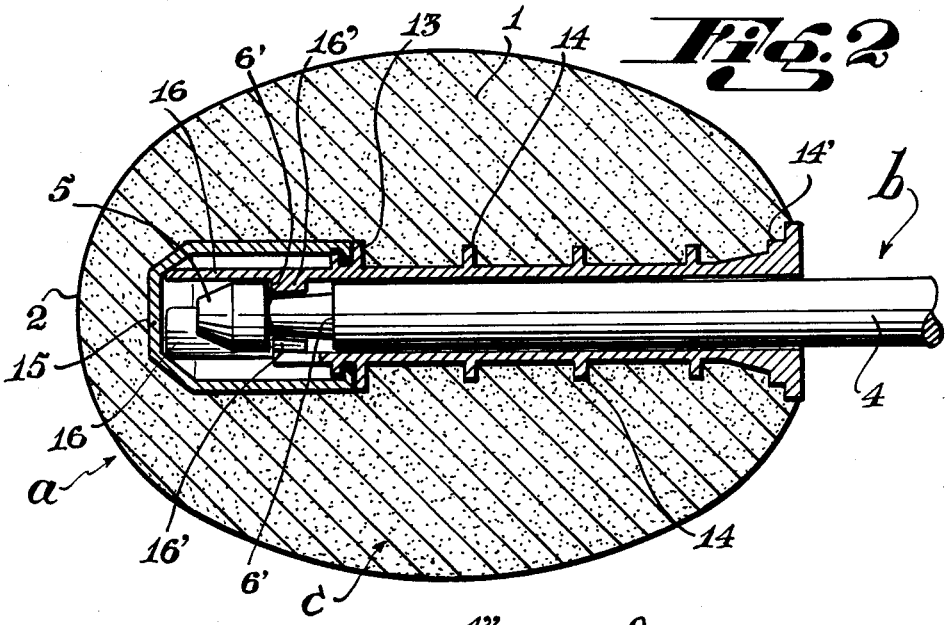

In the embodiments of FIGS. 1 and 2, the tubular body (c) extends its walls (3) towards the area opposite the one bearing the flat ring (13) by means of resilient flaps (16) (for example, three or four) having therein teeth or flanges (16'). The tubular body (3) also has a cap or cover (15) forming an inside bore sufficient to comprise all the locking area (16—16'), which -through an annular tooth and an equivalent wedge of body (3)-, may be engaged by force therein, as it can be seen from FIG. 2.

The ring (13), during the molding of the soap (1), is the only part remaining out of it forming the inlet of the longitudinal duct intended for the insertion of the end (4) corresponding to arm (b); flanges or teeth (16') are intended to be forcibly and decreasingly keyed -once the end (5) has been passed- in the annular slot (6) abutting in either direction against the flat edges (6') thereof which thus hinders the removal of the soap since any mono- or bi-directional movement on arm (b) is limited by the action of teeth (16') abutting against the flat faces (6') of the annular slot (6); said locking assembly remains shut inside cover or cap (15) forcibly keyed into body (3), thus preventing the soap-mass from entering said area and impeding the relative rotation of the soap (a) relative to arm (b) or the demounting of full sheath (c).

Cover (15) is only exposed once the soap has been used up and, if removed by a simple forced operation, in turn exposes the resilient flaps (16) which open to unkey teeth (16') from the annular slot (6) and its abutting faces (6'). Once the flaps (16) are opened, the tubular body (c) together with the used up soap can be easily removed, and thus a new and equivalent soap (a) be substituted into end (4) of arm (b) introducing end (5) through inlet of (13) until teeth (16') are forcibly and fixedly keyed again into parallel faces (6') of annular slot (6) (FIG. 2).

Figure 5:
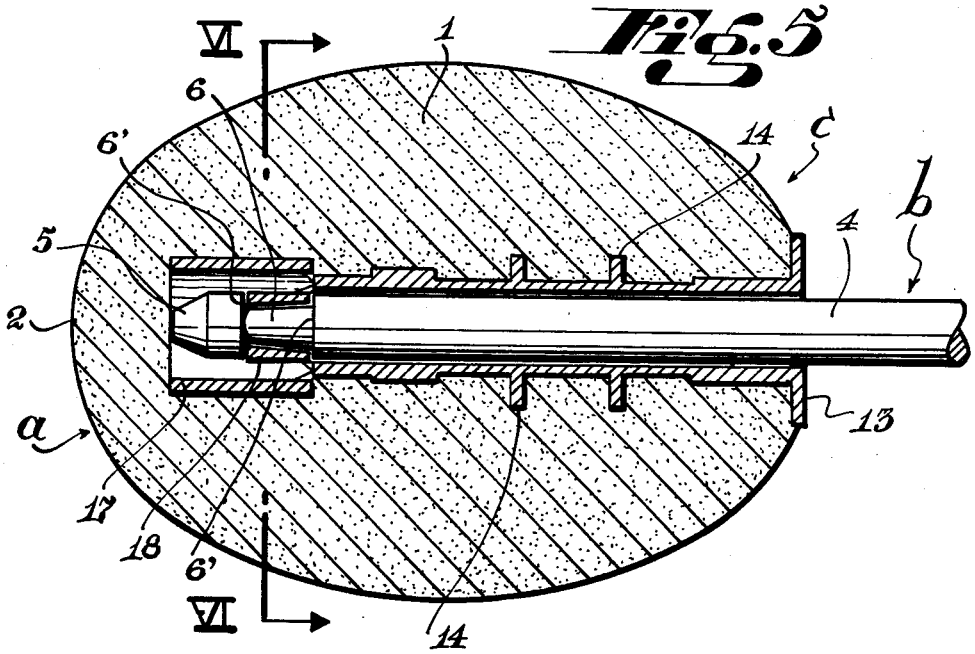
FIG. 5 is a longitudinal section of the soap-cake and the tubular body with the locking means according to FIG. 4, showing the way in which the soap is fixed to the mounting arm, its annular fastener being engaged by force in the slot.
Figure 6:
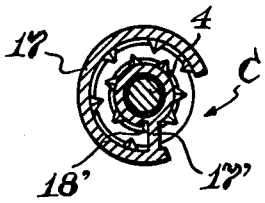
FIG. 6 is a cross-sectional view of the tubular body according to the embodiments of FIGS. 4 and 5 and to a plane VI—VI of FIG. 5, showing the structure of the tubular body or core which may be torn and of its control flaps.
Figure 7:
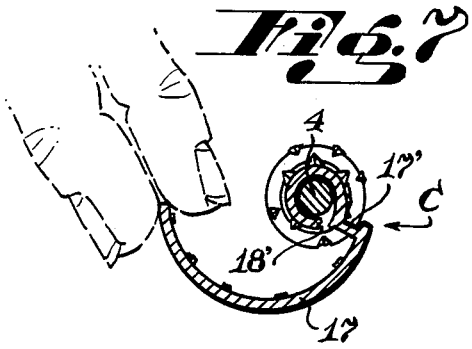
FIG. 7 is a detail of the cross-sectional view of FIG. 6 showing the way in which tearing of the tubular body is effected in order to eliminate the locking means once the soap has been used up.

In the embodiments of FIGS. 4 to 7, the tubular body (c), presents instead of resilient flaps (16) a core in the form of open ring (18) that, once forcibly keyed into annular slot (6) of arm (b) through the pass of head (5), is retained into said slot (6) with butts between faces (6'), as it can be seen from FIG. 5. Particularly, said annular core (18) is opened in a weakness line (18') which, through bridge (17'), joins said annular core (18) with a holder strip which renders possible the tearing effect (FIGS. 6 and 7).

Thus, only once the soap (a) has been used up, the tearing system of FIG. 6 is exposed, which -grasped by (17) according to FIG. 7-, may be removed from the rest of the used up soap remaining on tube (3), and therefore it can be removed from end (4) of arm (b) in order to effect replacement by a new and equivalent soap (a).

In the embodiment of FIGS. 8 to 12, the same principles have been followed, except for the tubular body (c) which is comprised of two half-pieces (3 and 3') hinged in one of their longitudinal edges and having on the other edge rims (19 and 19') with control holders (20) and male and female coupling means (21). Said means define the closed position of tube relative the outlet ring (13) to which opposes body (c) with an end shut to (13') inside which there are resilient flaps (22) intended to be forcibly keyed into annular slot (6) as the locking means of the system. The closed of the tubular body (c) is effected by means of ring (23) which passes in front of closed head (13') and is keyed into slot (23) of body (3—3') (FIGS. 8, 9, 9A, 10 and 10A).

In this way, once the soap (1) is used up and the sheath or tubular body 9 (c) is exposed, it is sufficient to remove ring (23) and to control -by means of holders (20)- the half-pieces (3 and 3') (FIG. 11) to effect aperture of the body (c) and its removal from arm (b) which thus is ready to receive another equivalent soap (a) with its tubular body (c) and locking means.

Finally, in the embodiment of FIGS. 13 to 22, the tubular body has been laterally closed by means of walls (3) and has been completed with a cover (15), as in the embodiment of FIGS. 1 and 2, showing lateral openings or passages (24) intended to allow the keying by force of pin (25), which, together with said openings (24) coincides with the insertion of soap (a) into slot (6) of end (4) corresponding to arm (b).

Figure 21:
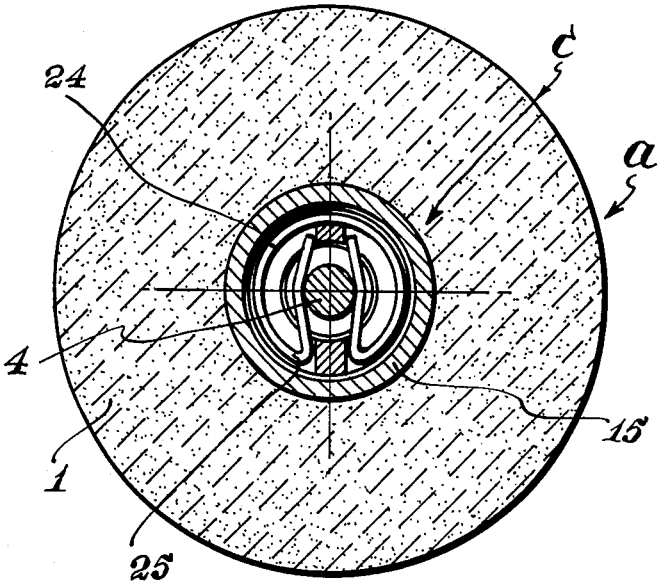
FIG. 21 is a cross-sectional view of the soap and its locking means, according to plane XXI—XXI of FIG. 20, showing the way in which the pin is fixed in the annular slot of the arm; and finally.
Figure 22:
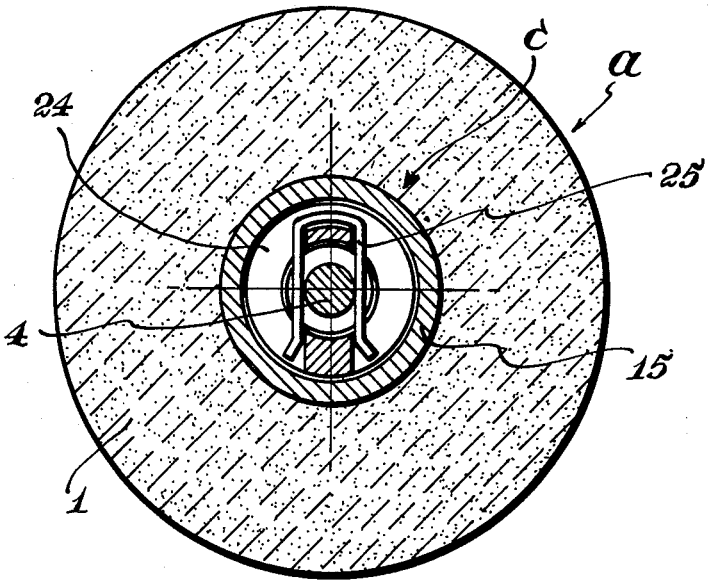
FIG. 22 is another cross-sectional view of the soap, similar to that of FIG. 21, but wherein the pin presents a different shape.

Pin (25) is keyed, as it can be seen from FIGS. (13 to 15) into lateral openings (24) of body (3) and remains therein, its internal branches forming a section of a diameter smaller than inside diameter of annular slot (6) (FIGS. 16 to 19) so that when end (4) of arm (b) enters (13) and head (5) forcibly passes between the internal branches of pin (25) they are thus opened and finally fixedly keyed into slot (6), the opposite and flat walls of which (6') prevent soap (a) from being removed (FIGS. 20 and 21).

The pin (25) may be of any suitable form (for example FIGS. 21 and 22), but the form of FIGS. 13 to 21 is more desirable. It has a width equivalent approximately the one of slot (6) in such a way as to hinder the insertion of soap therein, fact which is facilitated by the presence of cover (15) keyed over the end (13') and covering the locking area (25-6) (FIG. 20).

Thus, in this embodiment, and as indicated for the previous ones, the cover (15) is only exposed once the soap-mass (1) has been used up and is then removed together with pin (25), thus releasing tube (3) with the used up soap, which is then removed from the end (4) of arm (b) so that another equivalent soap (a) with tube (c) and the locking system already described, may be substituted.

Undoubtedly, when the invention herein will be put into practice, many modifications with respect to the details of construction and shape of the new locking system between soap and holder-arm may be made without departing from the fundamental principles clearly stated in appended claims.

I claim:

1. In combination, a cake of soap including an elongated tubular socket, a tubular conduit embedded in said socket, and a soap holder for connecting the soap to a support structure:

the soap holder comprising a rigid support arm including a forward portion having a longitudinal axis and an annular groove defined by two parallel surfaces extending transverse to the longitudinal axis;

the tubular conduit comprising (i) a tubular sidewall forming a tubular passageway to pass the forward portion of the support arm forward into the interior of the cake of soap, (ii) resilient locking means extending radially inward from the tubular sidewall and into the annular groove on the support arm and permanently locking the cake of soap securely thereto, (iii) a cover extending around the locking means and the annular groove to keep the soap away from the locking means and said annular groove, and (iv) means releasably connecting the cover to the tubular sidewall.

2. A combination according to claim 1 wherein the locking means includes a plurality of teeth.

3. A combination according to claim 1 wherein the means connecting the cover to the tubular sidewall includes:

first and second spaced, radial flanges integral with and radially extending outward from the tubular sidewall, rearward of the locking means; and a third flange integral with and radially extending inward from the cover, and captured between said first and second flanges to hold the cover in place.

4. A combination according to claim 1 wherein:

the tubular sidewall includes (i) an annular groove located outside of and radially aligned with the annular groove of the support arm, and (ii) at least one lateral opening extending through the tubular sidewall, radially inward from the annular groove thereof; and the locking means includes a clip seated in the annular groove of the tubular sidewall, and having at least one leg extending through the lateral opening of the tubular sidewall and into the annular groove of the support arm.

5. A combination according to claim 1 wherein:

the support arm includes a rearward portion having an axis;

the soap holder further comprises (i) an anchor for connecting the support arm to a surface, and including means defining a slot receiving the rearward portion of the support arm, and (ii) a finger secured to and extending outward from the rearward portion of the support arm, above the means defining the slot, and holding the support arm in said slot; and the anchor supports the support arm for pivotal movement about the axis of the rearward portion of the support arm, and the finger limits the pivotal movement of the support arm relative to the anchor.

* * * * *

UNITED STATES PATENT AND TRADEMARK OFFICE

CERTIFICATE OF CORRECTION

PATENT NO. : 4,688,751

DATED : August 25, 1987

INVENTOR(S) : Eduardo Aldredo Valot

It is certified that error appears in the above-identified patent and that said Letters Patent is hereby corrected as shown below:

Column 3, line 61: "soapholder" should read as --soap-holder--.

Column 3, lines 66-68: delete "circle surrounds a detail in longitudinal section of the shut tubular body corresponding to the locking area".

Column 7, line 6: "9(c)" should read as --(c)--.

Signed and Sealed this

Ninth Day of February, 1988

*Attest:*

*Attesting Officer*

DONALD J. QUIGG

*Commissioner of Patents and Trademarks*